US012036603B2

(12) United States Patent
Kimura et al.

(10) Patent No.: US 12,036,603 B2
(45) Date of Patent: Jul. 16, 2024

(54) CASTING MOLD

(71) Applicant: HONDA MOTOR CO., LTD., Tokyo (JP)

(72) Inventors: Satoru Kimura, Tokyo (JP); Kenji Yuki, Tokyo (JP); Ryo Onishi, Tokyo (JP); Nobuo Kawauchi, Tokyo (JP); Gaku Kazama, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 18/284,558

(22) PCT Filed: Apr. 27, 2022

(86) PCT No.: PCT/JP2022/019014
§ 371 (c)(1),
(2) Date: Sep. 28, 2023

(87) PCT Pub. No.: WO2022/211136
PCT Pub. Date: Oct. 6, 2022

(65) Prior Publication Data

US 2024/0189892 A1 Jun. 13, 2024

(30) Foreign Application Priority Data

Mar. 30, 2021 (JP) ..... 2021-057185

(51) Int. Cl.
*B22C 9/06* (2006.01)
*B22D 17/14* (2006.01)
(Continued)

(52) U.S. Cl.
CPC ..... *B22D 17/24* (2013.01); *B22C 9/067* (2013.01); *B22D 29/00* (2013.01)

(58) Field of Classification Search
CPC ..... B22C 9/06; B22D 17/14; B22D 17/22
See application file for complete search history.

(56) References Cited

FOREIGN PATENT DOCUMENTS

| | | |
|---|---|---|
| CN | 109079119 | 12/2018 |
| JP | 60-042447 | 3/1985 |

(Continued)

OTHER PUBLICATIONS

International Search Report and Written Opinion for International Application No. PCT/JP2022/019014 mailed on Jul. 19, 2022, 9 pages.

*Primary Examiner* — Kevin E Yoon
(74) *Attorney, Agent, or Firm* — Amin, Turocy & Watson, LLP

(57) ABSTRACT

Provided is a casting mold with which it is possible to apply air-blow to a bottom part of a groove in a core without moving forward/backward the core relative to the mold body. This casting mold is provided with a first mold and a second mold for forming, between the first mold and the second mold, a cavity used to produce a cast article, wherein the second mold has a second mold body and a core, which protrudes from the second mold body in a first direction toward the first mold and is used to forms a hollow part in the cast article, the core is provided with a groove part that opens in the first direction and is recessed in a second direction opposite from the first direction, and the second mold is provided with an air supply flow passage for supplying air for blowing toward a bottom part of the groove part.

4 Claims, 5 Drawing Sheets

(51) Int. Cl.
*B22D 17/24* (2006.01)
*B22D 29/00* (2006.01)

(56) References Cited

FOREIGN PATENT DOCUMENTS

| | | | | |
|---|---|---|---|---|
| JP | 11-309555 | | | 11/1999 |
| JP | 2005-324199 | | | 11/2005 |
| JP | 2005324199 | A | * | 11/2005 |
| JP | 2005-334938 | | | 12/2005 |

* cited by examiner

CASTING MOLD

TECHNICAL FIELD

The invention relates to a casting mold having a core for forming a hollow portion in a cast product.

BACKGROUND ART

A core may protrude into a cavity of a casting mold to form a hollow portion in a cast product. In this case, if burrs of a solidified molten metal attach to the core, there is a possibility that inclusion of the burrs in the cast product occurs in the subsequent casting and the cast product consequently becomes defective. For this reason, before the next casting, air blowing or the like is performed to remove such attached burrs from the core. However, the core may have a groove. For example, when a plurality of cores are arranged close to each other, a narrow gap (groove) is formed therebetween. Since it is difficult for air to enter deep into the groove, it is not easy to remove burrs attaching to the groove, particularly the deep portion of the groove, by air blowing.

JP S60-042447 U discloses a technique in which a molding pin projecting into a cavity is movable relative to a mold body to thereby facilitate air blowing between the outer periphery of the molding pin and the mold body. The molding pin is moved between a retracted position as a molding position and an advance position projecting from the retracted position toward the inside of the cavity, and air is blown at the advance position. However, in this technique, a mechanism for advancing and retracting the molding pin is required, and the structure of the casting mold becomes complicated.

SUMMARY OF THE INVENTION

An object of the present invention is to provide a casting mold capable of air-blowing the deep portion of the groove of cores without moving the cores forward and backward relative to a mold body.

According to an aspect of the present invention, there is provided a casting mold including: a first mold; and a second mold configured to relatively move toward and away from the first mold and form a cavity portion configured to manufacture a cast product, between the second mold and the first mold, wherein the second mold includes a second mold body and a core protruding from the second mold body in a first direction that is directed toward the first mold, the core being configured to form a hollow portion in the cast product, the core is provided with a groove portion that opens in the first direction and is recessed in a second direction opposite to the first direction, and the second mold is provided with an air supply flow path configured to supply air for blowing, to a bottom of the groove portion.

According to the present invention, it is possible to provide a casting mold in which air can be blown to a deep portion of a groove of a core without moving the core forward and backward relative to a mold body.

DETAILED DESCRIPTION OF THE INVENTION

The following describes a casting device 10 and a casting mold 12 according to an embodiment of the present invention.

Figure 1:
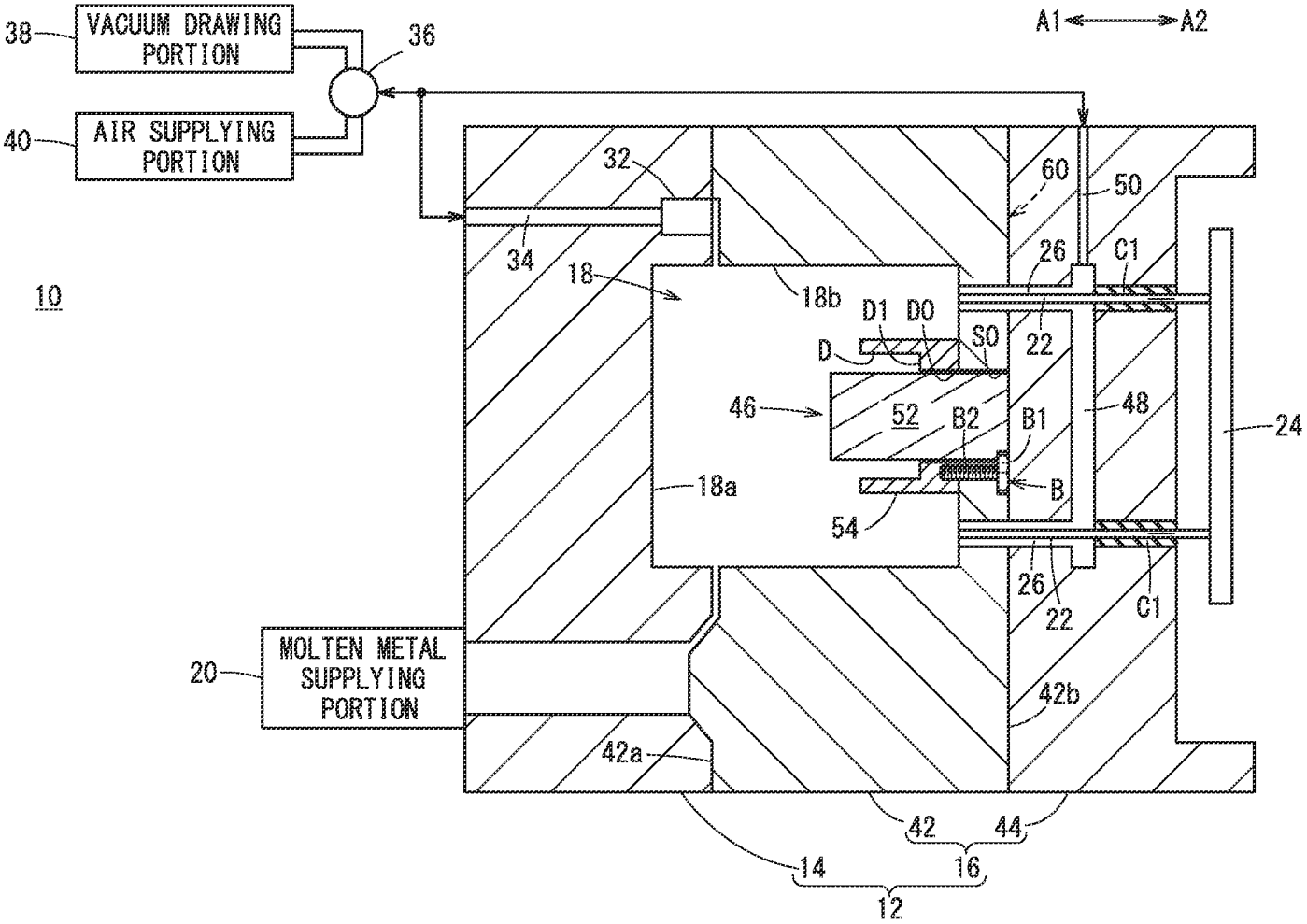
FIG. 1 is a diagram showing a casting device according to an embodiment.

The casting device 10 shown in FIG. 1 includes the casting mold 12. The casting mold 12 includes a fixed mold 14 and a movable mold 16 which are arranged to face each other in the left-right direction (horizontal direction) of the drawing. The movable mold 16 moves in the horizontal direction in a manner to be able to move toward and away from the fixed mold 14. Recessed portions 18*a*, 18*b* forming a cavity portion 18 are respectively formed on mating surfaces of the fixed mold 14 and the movable mold 16 which face each other. By bringing the movable mold 16 into abutment with the fixed mold 14, the casting mold 12 is closed, and the cavity portion 18 is formed inside the casting mold 12.

A molten metal supplying portion 20 is connected to the casting mold 12. The molten metal supplying portion 20 is provided on the fixed mold 14, and supplies molten metal to the inside of the cavity portion 18. The molten metal supplied to the cavity portion 18 is solidified inside the cavity portion 18, and the solidified molten metal is taken out from the casting mold 12 as a cast product.

The casting mold 12 includes ejector pins 22 and an ejector plate 24 for ejecting the cast product from the cavity portion 18. Pin insertion holes 26 for allowing the cavity portion 18 to communicate with the outside of the movable mold 16 are formed in the movable mold 16. The ejector pins 22 are inserted into the respective pin insertion holes 26. One end of each of the ejector pins 22 is connected to the ejector plate 24. By pushing the ejector plate 24 toward the fixed mold 14, the other end of the ejector pin 22 is inserted into the cavity portion 18 to facilitate the removal of the cast product from the cavity portion 18.

The casting mold 12 includes a shut-off valve 32 and a suction path 34. The shut-off valve 32 is provided between the cavity portion 18 and the suction path 34, and shuts off the suction path 34 to prevent the molten metal from entering the suction path 34 from the cavity portion 18.

The suction path 34 is connected to a vacuum drawing portion 38 via a switching valve 36. The vacuum drawing portion 38 draws a vacuum inside the cavity portion 18 via the suction path 34. An air supplying portion 40 is connected to the switching valve 36, along with the vacuum drawing portion 38. The air supplying portion 40 causes air for blowing to flow (air-blowing) into the casting mold 12 in an open state, via the switching valve 36 and the suction path 34, to clean the suction path 34, the shut-off valve 32, and the like. The switching valve 36 switches a connection target of the suction path 34 between the vacuum drawing portion 38 and the air supplying portion 40.

Hereinafter, the movable mold 16 will be described in detail. As shown in FIG. 1, the movable mold 16 includes a movable mold body 42, a support member 44, and a core 46. A direction from the movable mold 16 toward the fixed mold 14 is referred to as a first direction A1, and a direction opposite to the first direction A1 is referred to as a second direction A2.

The support member 44 is fixed to the movable mold body 42 by bolts or the like and supports the movable mold body 42. The support member 44 contains therein an internal space 48 communicating with the pin insertion hole 26 and a suction path 50 connecting the internal space 48 and the switching valve 36. The vacuum drawing portion 38 draws a vacuum inside the pin insertion hole 26 and the cavity portion 18 via the suction path 50 and the internal space 48. The air supplying portion 40 supplies air for blowing, to the inside of the pin insertion hole 26 and further to the inside of the cavity portion 18, via the suction path 50 and the internal space 48. A tubular sealing member C1 such as a bushing is inserted into the pin insertion hole 26 on the outer side of the internal space 48. The sealing member C1 prevents air from flowing into the cavity portion 18 from the outside of the support member 44 through the pin insertion hole 26.

Figure 2:
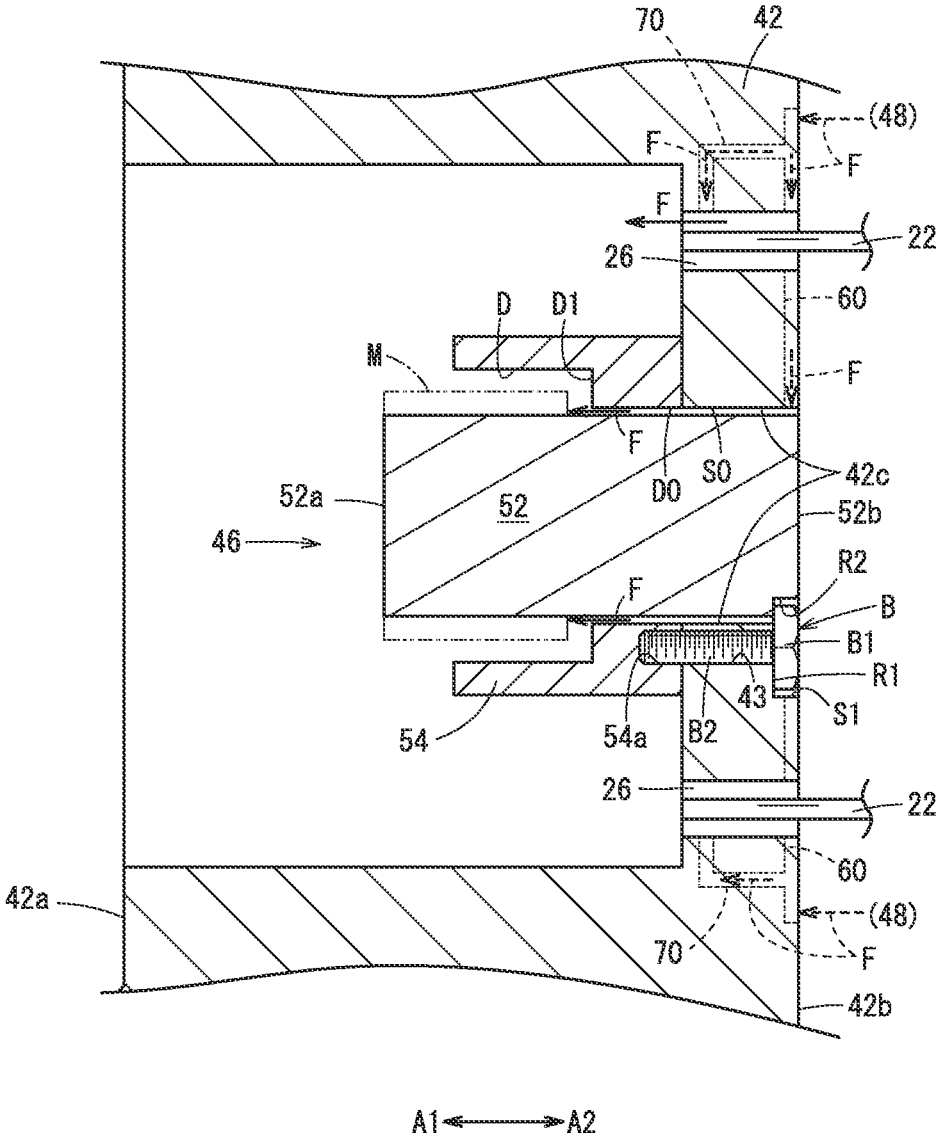
FIG. 2 is an enlarged view of a movable mold body of the casting mold.
Figure 3:
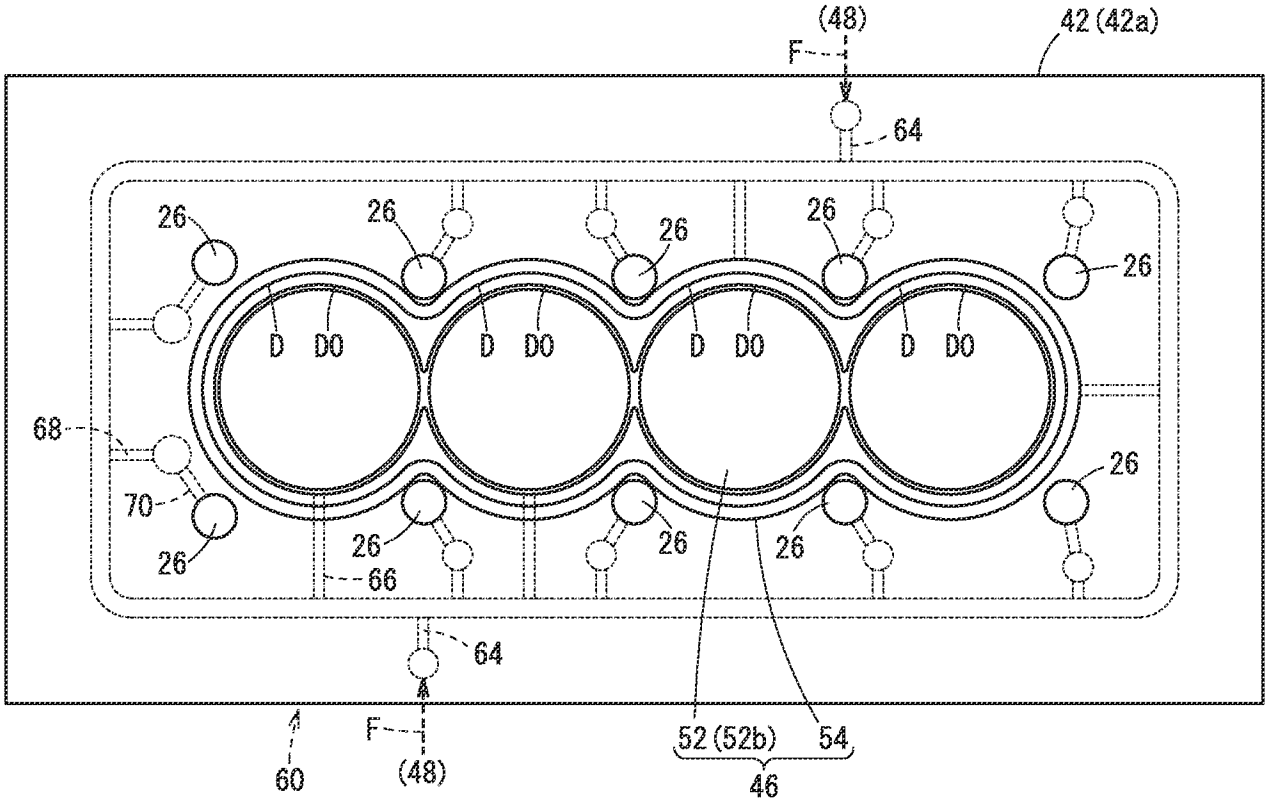
FIG. 3 is a view showing a cavity portion side of the movable mold body.
Figure 4:
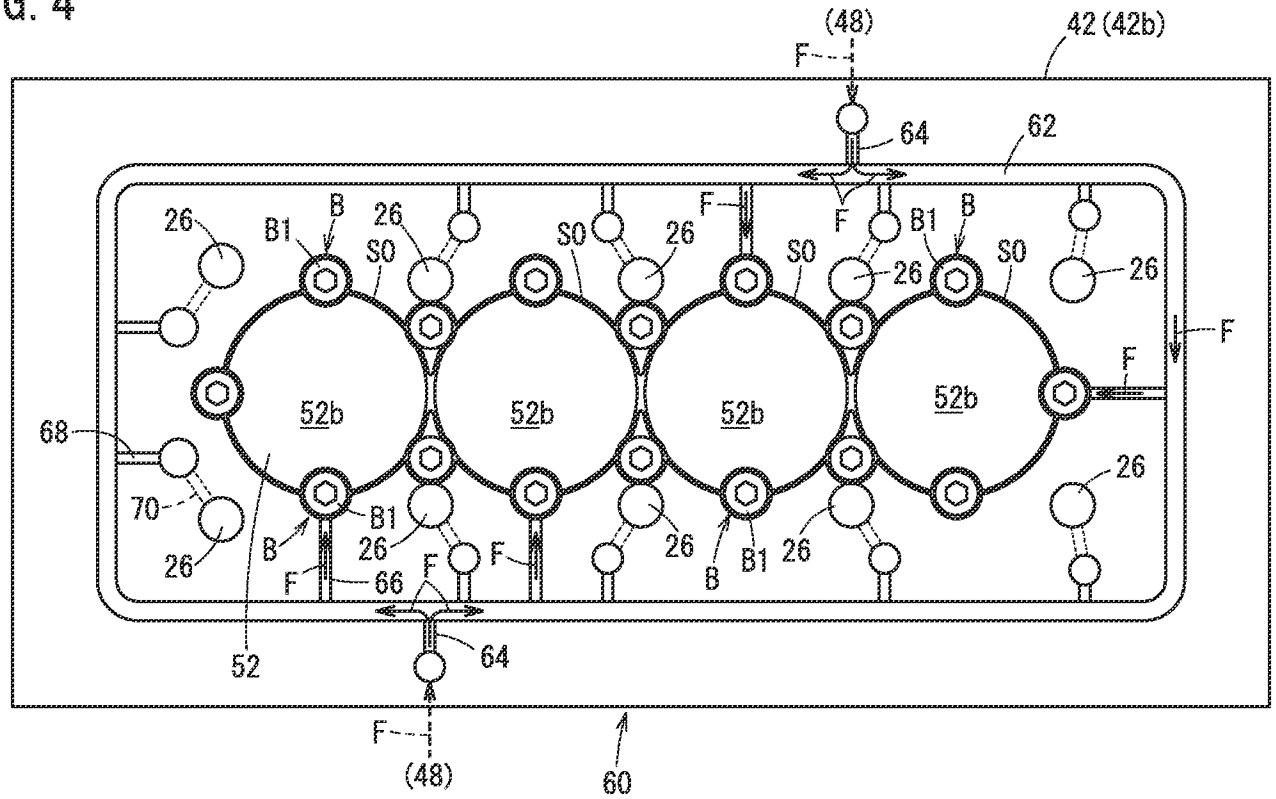
FIG. 4 is a view showing a side opposite to the cavity portion side of the movable mold body.

FIG. 2 is an enlarged view of the movable mold body 42 of the casting mold 12. FIG. 3 is a view showing the cavity portion 18 side of the movable mold body 42. FIG. 4 is a view showing a side opposite to the cavity portion 18 side of the movable mold body 42. Basically, the movable mold body 42 and the core 46 will be described in detail with reference to FIG. 2.

The movable mold body 42 has a first surface 42*a* facing the fixed mold 14 and a second surface 42*b* on the opposite side of the first surface 42*a*. The movable mold body 42 includes a core through-hole 42*c* formed in the second surface 42*b*, to allow the cavity portion 18 to communicate with the second surface 42*b* side.

The core 46 protrudes in the first direction A1, and functions to form a hollow portion in a cast product (for example, a cylinder block of an engine). The core 46 includes a first core 52 and a second core 54.

The first core 52 is, for example, a bore-forming core for forming a cylinder bore in a cylinder block, and has a columnar shape having a head portion 52*a* on the cavity portion 18 side and a bottom portion 52*b* on the opposite side to the cavity portion 18 side. A clearance S0 is formed between the inner peripheral surface of the core through-hole 42*c* and the outer peripheral surface of the first core 52. The clearance S0 is a minute space having a size that allows gas to pass therethrough but prevents liquid from passing therethrough. Therefore, at the time of casting, the molten metal introduced into the cavity portion 18 flows into (reaches) the bottom D1 of a groove portion D described later, but does not flow into the clearance S0.

The first core 52 is inserted into the core through-hole 42*c* of the movable mold body 42 and is fixed to the movable mold body 42 such that the end surface of the bottom portion 52*b* does not protrude from the second surface 42*b* of the movable mold body 42 (for example, such that the end surface of the bottom portion 52*b* is substantially flush with the second surface 42*b*). In this example, the first core 52 is fixed by a bolt B. That is, the first core 52 is locked by the bolt B fixed to the movable mold body 42, and is thereby prevented from coming off from the movable mold body 42 in the second direction A2. Incidentally, the first core 52 is prevented from coming off from the movable mold body 42 in the first direction A1, by a retaining portion (not shown). The head portion B1 of the bolt B is disposed across the movable mold body 42 and the first core 52. That is, at the peripheral edge of the core through-hole 42*c*, a recessed portion R1 is formed in the second surface 42*b* of the movable mold 16, and a recessed portion R2 is formed in the bottom portion 52*b* of the first core 52. The head portion B1 of the bolt B is accommodated in the recessed portion R1 and the recessed portion R2 so as not to protrude from the second surface 42*b* of the movable mold body 42 (for example, such that an end surface of the head portion B1 of the bolt B is substantially flush with the second surface 42*b*). Before casting, a tubular wear resistant member M (for example, an iron sleeve) may be attached to the outer periphery of the first core 52. The wear resistant member M is cast into the cast product to improve the wear resistance of the cast product.

The second core 54 is, for example, a jacket-forming core for forming a water jacket. The water jacket is provided outside the cylinder bore formed by the first core 52 and along the cylinder bore. The second core 54 extends along the outer periphery of the first core 52 and has a shape surrounding the first core 52 (see FIG. 3). The second core 54 covers at least a part of the outer peripheral surface of the first core 52 to form a groove portion D between the first core 52 and the second core 54. The groove portion D opens in the first direction A1 and is recessed in the second direction A2. In the present embodiment, the groove portion D has a shape in which a plurality of cylinders respectively surrounding the plurality of (four in this example) first cores 52 are arranged side by side in the circumferential direction and connected together (see FIG. 3). However, the groove portion D does not necessarily have to go around the first core 52 as described above, and may surround at least a part of the outer peripheral surface of the first core 52.

The groove portion D has a bottom D1. A clearance D0 is formed between the second core 54 and the outer peripheral surface of the first core 52 on the second direction A2 side of the bottom D1. The clearance D0 is narrower than the groove portion D, and like the clearance S0, is a minute space having a size that allows gas to pass therethrough but prevents liquid from passing therethrough. Therefore, at the time of casting, the molten metal introduced into the cavity portion 18 flows into (reaches) the bottom D1 of the groove portion D, but does not flow into the clearance D0 (further into the clearance S0).

Here, the second core 54 is attached to a portion of the movable mold body 42 that faces toward the cavity portion 18. The second core 54 is attached to the movable mold body 42, together with the first core 52, by a plurality of bolts B. The shaft portion B2 (male screw) of the bolt B is screw-engaged into a screw hole 54*a* (female screw) provided in the second core 54. The shaft portion B2 of the bolt B is inserted into a bolt insertion hole 43 formed in the movable mold body 42. However, similarly to the first core 52, the second core 54 may be attached to the second surface 42*b* side of the movable mold body 42 and may be attached by a fastener other than the bolt B.

The movable mold 16 is provided with an on-surface flow path 60 for supplying a blowing air F to (the bottom D1 of) the groove portion D. As shown in FIG. 4, the on-surface flow path 60 is formed on the second surface 42*b* of the movable mold body 42, and includes a peripheral flow path 62, a branch flow path 64, a coupling flow path 66, and a suction path 68. Further, the movable mold 16 contains therein a suction path 70 that allows the suction path 68 to communicate with the pin insertion hole 26.

The peripheral flow path 62 is disposed around the bottom portion 52*b* of the first core 52. In this embodiment, the peripheral flow path 62 is a ring-shaped flow path that goes around so as to surround the bottom portions 52*b* of the plurality of (four in this embodiment) first cores 52. By forming the peripheral flow path 62 into a ring shape, the pressure in the peripheral flow path 62 is made uniform, and the uniformity of air-blowing into the groove portion D by the air F supplied from the peripheral flow path 62 can be improved. However, the peripheral flow path 62 does not necessarily need to have a ring shape and may be disposed around the bottom portions 52*b* of the first cores 52.

The branch flow path 64 has one end connected to the internal space 48 in the support member 44 and the other end connected to the peripheral flow path 62. One end of the coupling flow path 66 is connected to the peripheral flow path 62. The other end of the coupling flow path 66 communicates with the clearance S0 formed between the inner peripheral surface of the core through-hole 42*c* and the outer peripheral surface of the first core 52. That is, the air F flowing into the peripheral flow path 62 from the internal space 48 flows into the clearance S0 via the peripheral flow path 62 and the coupling flow path 66. The clearance S0 communicates with (the bottom D1 of) the groove portion D via the clearance D0 (see FIG. 2). Therefore, the clearance S0 and the clearance D0 function as an air introduction path which allows the coupling flow path 66 and the groove portion D to communicate with each other and introduce the air F to (the bottom D1 of) the groove portion D.

Figure 5:
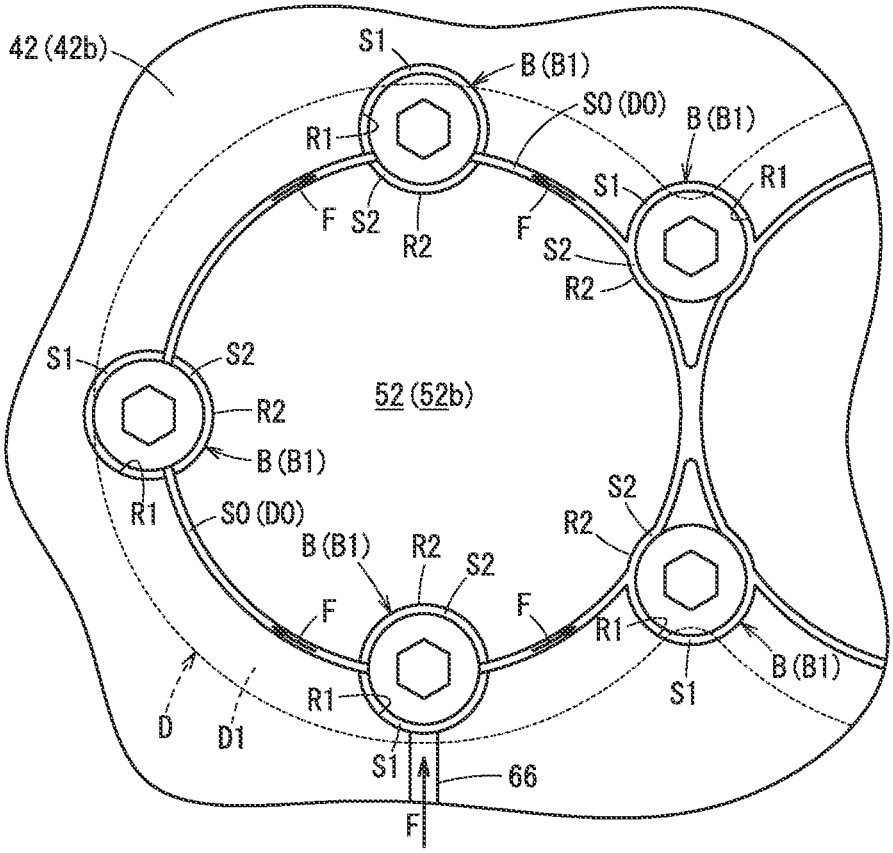
FIG. 5 is an enlarged view of part of FIG. 4.

Here, as shown in FIG. 4, the head portion B1 of the bolt B is disposed across the movable mold body 42 and the first core 52. FIG. 5 is an enlarged view of part of FIG. 4. Here, as shown in FIG. 5, the diameter of the recessed portion R1 at the second surface 42*b* of the movable mold 16 is made larger than the diameter of the head portion B1 of the bolt B, whereby a clearance S1 is formed between the outer peripheral surface of the head portion B1 of the bolt B and the inner peripheral surface of the recessed portion R1. The clearance S1 constitutes a part of the coupling flow path 66 which allows (the bottom D1 of) the groove portion D to communicate with the peripheral flow path 62 via the clearance S0 and the clearance D0. As a result, the flow of the air F is not obstructed by the head portion B1 of the bolt B, and the air F can be suitably guided to the groove portion D of the core 46. In addition to this, the diameter of the recessed portion R2 at the end surface of the bottom portion 52*b* of the first core 52 may be made larger than the diameter of the head portion B1 of the bolt B, whereby the clearance S2 may be formed between the outer peripheral surface of the head portion B1 of the bolt B and the inner peripheral surface of the recessed portion R2, thereby further improving the ease of flow of the air F between the coupling flow path 66 and the clearance S0.

In this way, the air F from the air supplying portion 40 reaches the internal space 48 via the suction path 50 (see FIG. 1), and is supplied into the groove portion D via the on-surface flow path 60 (more specifically, the branch flow path 64, the peripheral flow path 62, and the coupling flow path 66 shown in FIG. 4), the clearance S0, and the clearance DO as shown in FIG. 2. The air F supplied into the groove portion D advances in the groove portion D in the first direction A1 and blows out (air-blowing) from the opening of the groove portion D into the cavity portion 18, and as a result, it is possible to remove burrs attaching to the inside of the groove portion D, in particular, the bottom D1 of the groove portion D. In this way, the branch flow path 64, the peripheral flow path 62, and the coupling flow path 66 function as an air supply flow path for supplying the blowing air F toward the bottom D1 of the groove portion D.

As shown in FIG. 4, the suction path 68 has one end connected to the peripheral flow path 62 and the other end communicating with the pin insertion hole 26 via the suction path 70. Since the pin insertion hole 26 communicates with the cavity portion 18 (see FIG. 2), the other end of the suction path 68 (the on-surface flow path 60) communicates with the cavity portion 18 via the suction path 70 and the pin insertion hole 26. As shown in FIG. 2, the air F that has reached the internal space 48 from the air supplying portion 40 is blown into the cavity portion 18 via the on-surface flow path 60 (more specifically, the branch flow path 64, the peripheral flow path 62, and the suction path 68 in FIG. 4), the suction path 70, and the pin insertion hole 26 (air blow).

When the vacuum drawing portion 38 is connected to the suction path 50 in place of the air supplying portion 40 by the operation of the switching valve 36, vacuum drawing is performed via the path through which the air F has been supplied. That is, the vacuum drawing portion 38 can draw a vacuum inside the cavity portion 18 via the internal space 48, the on-surface flow path 60 (more specifically, the branch flow path 64, the peripheral flow path 62, and the suction path 68), the suction path 70, and the pin insertion hole 26. In this way, the branch flow path 64, the peripheral flow path 62, and the suction path 68 function as a backing suction path for drawing a vacuum inside the cavity portion 18 via the pin insertion hole 26. In addition, the branch flow path 64 and the peripheral flow path 62 (in particular, the peripheral flow path 62) are common flow paths (shared flow paths) that also function as the above-described air supply flow path (branch flow path 64, peripheral flow path 62, and coupling flow path 66), in addition to the backing suction path.

As described above, in the casting mold 12 according to the embodiment, air can be blown into the groove portion D through the branch flow path 64, the peripheral flow path 62, and the coupling flow path 66. Here, conditions for efficiently blowing air into the groove portion D will be explained. The amount of air F flowing into the movable mold 16 from the suction path 50 is defined as an air amount Q. The air amount Q can be divided into an air amount Qin flowing into the cavity portion 18 and an air amount Qout flowing out of the cavity portion 18 (out of the movable mold 16). Further, the air amount Qin flowing into the cavity portion 18 is divided into an air amount Qin1 flowing thereinto through the pin insertion hole 26 and an air amount Qin2 flowing thereinto through the groove portion D.

In order to efficiently supply the air F into the cavity portion 18, it is preferable to insert the sealing member C1 into the pin insertion hole 26 to thereby reduce the air amount Qout. As a result, the amount of air Qout which does not flow into the cavity portion 18 can be made not to exceed the air amount Qin1 which flows into the cavity portion 18 from the pin insertion hole 26 or the air amount Qin2 which flows into the cavity portion 18 from the groove portion D (Qout≤Qin1, Qin2). Further, in order to blow air into the groove portion D, it is preferable that the air amount Qin2 should have a certain degree of amount relative to the air amount Qin1 (for example, Qin2/Qin1=0.4 to 1.0). This can be achieved by appropriately setting the conductance (width, length, and the like of the flow path) of the on-surface flow path 60 and the like.

Invention Understandable from the Embodiment

The following is a record of the invention that can be understood from each embodiment described above.

(1) The casting mold (12) includes: the first mold (fixed mold 14); and the second mold (movable mold 16) configured to relatively move toward and away from the first mold and form the cavity portion (18) configured to manufacture the cast product, between the second mold and the first mold. The second mold includes the second mold body (movable mold body 42) and the core (46) protruding from the second mold body in the first direction (A1) that is directed toward the first mold, the core (46) being configured to form a hollow portion in the cast product. The core is provided with the groove portion (D) that opens in the first direction and is recessed in the second direction (A2) opposite to the first direction. The second mold is provided with the air supply flow path (on-surface flow path 60) configured to supply air for blowing, to the bottom (D1) of the groove portion. With the above configuration, by supplying the blowing air from the air supply flow path toward the bottom of the groove portion, air can be easily and reliably blown into the groove portion of the core.

(2) The core includes the first core (52) and the second core (54) that covers at least a part of the outer peripheral surface of the first core to form the groove portion between the first core and the second core, the second mold body includes the core through-hole (42*c*) through which the first core is inserted, and the air supply flow path includes the air introduction path (clearance S0) formed between the inner peripheral surface of the core through-hole and the outer peripheral surface of the first core and communicating with the bottom of the groove portion. With this configuration, it is possible to blow air into the groove portion of the core by using the air introduction path formed between the inner peripheral surface of the core through-hole and the outer peripheral surface of the first core.

(3) The casting mold includes the ejector pin (22) configured to eject the cast product from the cavity portion, the second mold includes: the pin insertion hole (26) that communicates with the cavity portion and through which the ejector pin is inserted; and the backing suction path (on-surface flow path 60) communicating with the pin insertion hole and through which a vacuum is drawn inside the cavity portion via the pin insertion hole, and a part (peripheral flow path 62) of the backing suction path also serves as a part of the air supply flow path. Thus, it is possible to blow air into the groove portion of the core by using a part of the backing suction path for drawing a vacuum inside the cavity portion.

(4) The core includes the first core and the second core that covers at least a part of the outer peripheral surface of the first core to form the groove portion between the first core and the second core, the second mold body includes the core through-hole through which the first core is inserted, the air supply flow path includes the air introduction path (coupling flow path 66) formed between the inner peripheral surface of the core through-hole and the outer peripheral surface of the first core and communicating with the bottom of the groove portion, the casting mold includes the ejector pin (22) configured to eject the cast product from the cavity portion, the second mold includes: the pin insertion hole (26) that communicates with the cavity portion and through which the ejector pin is inserted; and the backing suction path (on-surface flow path 60) communicating with the pin insertion hole and through which a vacuum is drawn inside the cavity portion via the pin insertion hole, the second mold body includes the first surface (42*a*) facing the first mold and the second surface (42*b*) opposite to the first surface, and the second surface is provided with: the shared flow path (peripheral flow path 62) serving as both the air supply flow path and the backing suction path; the air supply branch flow path branching from the shared flow path and communicating with the air introduction path; and the suction branch flow path (suction path 68) branching from the shared flow path and communicating with the pin insertion hole. With this configuration, the shared flow path formed in the second surface of the second mold can be used for both the air blowing of the groove portion of the core and the suction of the cavity portion.

(5) The second mold includes a bolt (B) configured to fix the first core to the second mold body, the second mold includes the recessed portion (R1) in which the head portion (B1) of the bolt is accommodated, and the space (clearance S1) between the outer peripheral surface of the head portion of the bolt and the inner peripheral surface of the recessed portion forms a part of the air supply flow path. Thus, the bolt for fixing the first core to the second mold body can be prevented from interfering with the supply of the blowing air.

(6) The core includes the first core and the second core that covers at least a part of the outer peripheral surface of the first core to form the groove portion between the first core and the second core, the cast product is a cylinder block of an engine, the first core is a bore-forming core configured to form a cylinder bore inside the cylinder block, and the second core is a jacket-forming core configured to form a water jacket provided outside the cylinder bore along the cylinder bore. As a result, it is possible to blow air into the groove portion (clearance) between the bore-forming core and the jacket-forming core.

What is claimed is:

1. A casting mold comprising:

a first mold; and a second mold configured to relatively move toward and away from the first mold and form a cavity portion configured to manufacture a cast product, between the second mold and the first mold, wherein the second mold includes a second mold body and a core protruding from the second mold body in a first direction that is directed toward the first mold, the core being configured to form a hollow portion in the cast product, the core is provided with a groove portion that opens in the first direction and that is recessed in a second direction opposite to the first direction, and the second mold is provided with an air supply flow path configured to supply air for blowing, to a bottom of the groove portion, wherein the core includes a first core and a second core that covers at least a part of an outer peripheral surface of the first core to form the groove portion between the first core and the second core, the second mold body includes a core through-hole through which the first core is inserted, and the air supply flow path includes an air introduction path formed between an inner peripheral surface of the core through-hole and the outer peripheral surface of the first core and communicating with the bottom of the groove portion, and wherein the second mold includes a bolt configured to fix the first core to the second mold body, the second mold includes a recessed portion in which a head portion of the bolt is accommodated, and a space between an outer peripheral surface of the head portion of the bolt and an inner peripheral surface of the recessed portion forms a part of the air supply flow path.

2. The casting mold according to claim 1, wherein the casting mold includes an ejector pin configured to eject the cast product from the cavity portion, the second mold includes:

a pin insertion hole that communicates with the cavity portion and through which the ejector pin is inserted; and a backing suction path that communicates with the pin insertion hole and through which a vacuum is drawn inside the cavity portion via the pin insertion hole, and a part of the backing suction path also serves as a part of the air supply flow path.

3. The casting mold according to claim 1, the casting mold includes an ejector pin configured to eject the cast product from the cavity portion, the second mold includes:

a pin insertion hole that communicates with the cavity portion and through which the ejector pin is inserted; and a backing suction path that communicates with the pin insertion hole and through which a vacuum is drawn inside the cavity portion via the pin insertion hole, the second mold body includes a first surface facing the first mold and a second surface opposite to the first surface, and the second surface is provided with: a shared flow path serving as both the air supply flow path and the backing suction path; an air supply branch flow path branching from the shared flow path and communicating with the air introduction path; and a suction branch flow path branching from the shared flow path and communicating with the pin insertion hole.

4. The casting mold according to claim 1, wherein the core includes a first core and a second core that covers at least a part of an outer peripheral surface of the first core to form the groove portion between the first core and the second core, the cast product is a cylinder block of an engine, the first core is a bore-forming core configured to form a cylinder bore inside the cylinder block, and the second core is a jacket-forming core configured to form a water jacket provided outside the cylinder bore along the cylinder bore.

* * * * *